United States Patent [19]

Nadkarni

[11] 4,077,816

[45] Mar. 7, 1978

[54] DISPERSION-STRENGTHENED METALS

[75] Inventor: Anil V. Nadkarni, Mentor, Ohio

[73] Assignee: SCM Corporation, New York, N.Y.

[21] Appl. No.: 543,425

[22] Filed: Jan. 23, 1975

Related U.S. Application Data

[62] Division of Ser. No. 384,028, Jul. 30, 1973, Pat. No. 3,893,844.

[51] Int. Cl.[2] ..... B22F 3/00; B22F 1/00

[52] U.S. Cl. ..... 148/126; 75/211; 75/206

[58] Field of Search ..... 148/126; 75/211, 206

[56] References Cited

U.S. PATENT DOCUMENTS

| | | | |
|---|---|---|---|
| 3,655,458 | 4/1972 | Reichman | 148/126 |
| 3,779,714 | 12/1973 | Nadkarni et al. | 29/182.5 |
| 3,893,844 | 7/1975 | Nadkarni | 29/182.5 |

*Primary Examiner*—Brooks H. Hunt

*Attorney, Agent, or Firm*—Thomas M. Schmitz

[57] ABSTRACT

A dispersion-strengthened metal wherein the improvement comprises recrystallizing alloy powder prior to internal oxidation to increase the grain size of the alloy to at least about ASTM (E-112) Grain Size No. 6 to reduce the grain boundary area in the alloy powder whereby the recrystallized alloy powder provides substantially improved structural properties in the dispersion-strengthened metal product.

2 Claims, 2 Drawing Figures

DISPERSION-STRENGTHENED METALS

This is a division of application Ser. No. 384,028, filed July 30, 1973, now U.S. Pat. No. 3,893,844.

This is related to U.S. Pat. No. 3,779,714 filed on Jan. 13, 1972, and said application is incorporated herein by reference.

BACKGROUND OF THE INVENTION

Dispersion strengthening has been recognized in the past as a method for increasing strength and hardness of metals. A solid solution alloy comprising relatively noble matrix metal having relatively low heat or free energy of oxide formation and a solute metal having relatively high negative heat or free energy of oxide formation wherein the alloy is heated under oxidizing conditions to preferentially oxidize the solute metal. This technique is known in the art as in situ internal oxidation of the solute metal to the solute metal oxide or more simply "internal oxidation."

Dispersion-strengthened metal products, such as copper dispersion strengthened with aluminum oxide, have many commercial and industrial uses wherein high temperature strength properties and high electrical and/or thermal conductivities are desired or required in the finished product. Such commercial uses include frictional brake parts such as linings, facings, drums, and other machine parts for friction applications. Other commercial uses include electrical contact points, resistance welding electrodes, electrodes generally, electrical switches and switch gears, transistor assemblies, wires for solderless connections, wires for electrical motors, and many other uses requiring good electrical and thermal conductivities together with good strength and hardness at elevated temperatures.

Several prior art processes for internal oxidation have been suggested, such as disclosed in the Schreiner patent, U.S. No. 3,488,185; the McDonald patent, U.S. No. 3,552,954; and the Grant patent, U.S. No. 3,179,515. The prior art processes require delicate control over the partial pressure of oxygen during oxidation, or require removal of an oxidant residue which otherwise would form defects in the dispersion-strengthened metal.

Copending application now being U.S. Pat. No. 3,779,714 provides an improved alloy-oxidant mixture by providing for assimilation of the oxidant residue into the dispersion-strengthened metal wherein the oxidant residue is dispersion strengthened during thermal coalescence by a hard, refractory metal oxide provided in the oxidant. The oxidant residue formed during internal oxidation is not required to be removed from the dispersion-strengthened metal but rather is dispersion strengthened by the hard, refractory metal oxide during coalescence to form an integral part of the dispersion-strengthened metal stock.

It has been found that dispersion-strengthened metals produced by internal oxidation have substantially improved properties if the alloy powder is recrystallized prior to internal oxidation in order to increase the grain size of the alloy powder to at least ASTM Grain Size No. 6 as measured by ASTM Test No. E-112.

Accordingly, it is a primary objective of this invention to increase the grain size and reduce the grain boundary area in the alloy powder prior to the step of internal oxidation in processes for dispersion strengthening of metals.

A further objective and advantage of this invention is to provide reduced grain boundaries to substantially eliminate the concentration of solute metal oxide at the grain boundaries of the alloy during internal oxidation. This provides a dispersion-strengthened metal product having sustained resistance to preferential stress failure at the grain boundaries.

A still further objective is to provide a dispersion-strengthened metal product having a finer and more uniform distribution of dispersoid particles which result in improved elevated temperature properties.

A further object of this invention is to minimize formation of inner oxide film of solute metal oxide within the alloy during internal oxidation by increasing the grain size of the alloy prior to internal oxidation which advantageously permits higher oxidation temperatures as well as decreasing oxidation time.

A still further objective is to permit increased amounts of solute metal oxide which advantageously provide improved strength properties particularly at elevated temperatures.

A still further objective is to dispersion strengthen larger alloy particles which advantageously permits increased yield.

These and other advantages will become more apparent from the detailed description of the invention.

SUMMARY OF THE INVENTION

Briefly, this invention provides an alloy-oxidant mixture adapted to be internally oxidized wherein the alloy powder is recrystallized at elevated temperatures prior to the step of internal oxidation for a time sufficient to increase the grain size of the alloy powder to at least ASTM (E-112) Grain Size No. 6.

IN THE DRAWINGS

FIG. 1 is a microphotograph magnified 500 times showing internally oxidized aluminum alloy powder without prior recrystallization; and FIG. 2 is a microphotograph magnified 500 times indicating internally oxidized aluminum alloy powder recrystallized prior to internal oxidation in accordance with this invention to obtain a grain size No. 6 as measured by ASTM Test E-112.

DETAILED DESCRIPTION OF THE INVENTION

This invention pertains to dispersion-strengthened metals produced by internal oxidation of alloy powders wherein the improvement comprises recrystallizing the alloy powder to increase the grain size of the alloy prior to the internal oxidation step. Thereafter, the recrystallized powdered alloy is suitable for intimately intermixing with oxidant, internally oxidized, and then coalesced and formed into dispersion-strengthened metal stock.

Figure 1:
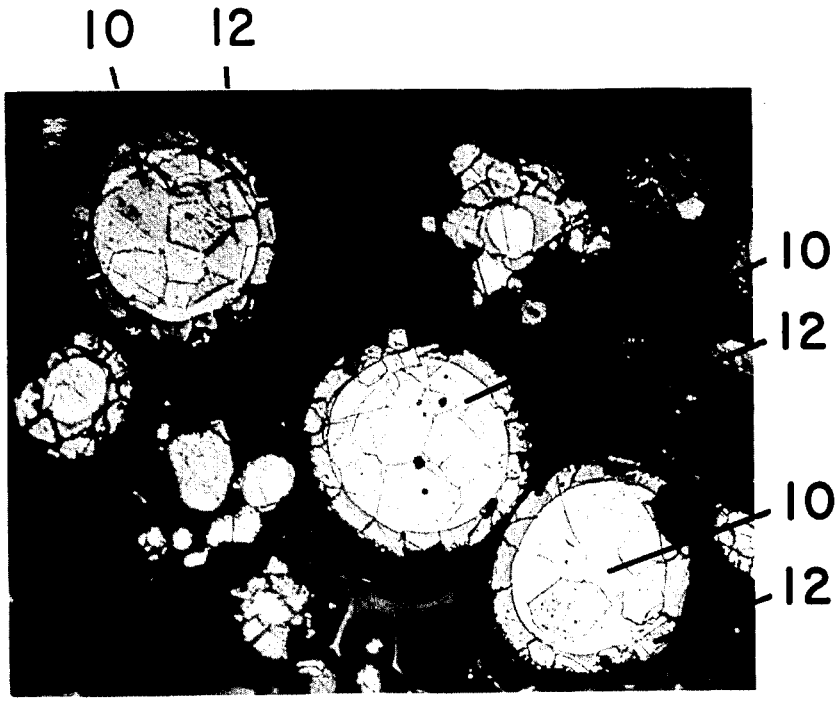
Figure 2:
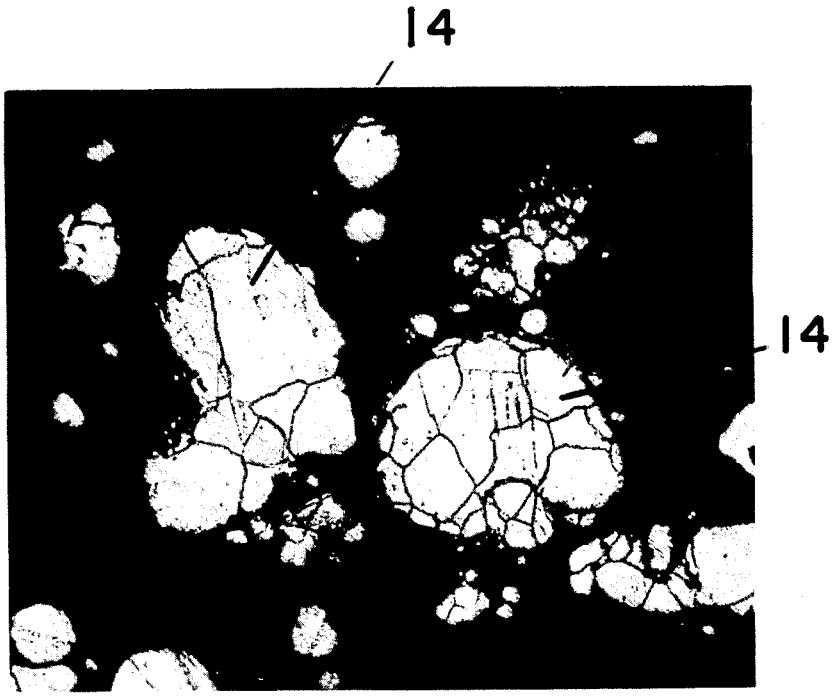

Referring first to the drawings, FIG. 1 indicates a copper alloy containing about 0.70% by weight of aluminum which was internally oxidized but without prior recrystallization. Shown on the outer periphery of the copper alloy 10 is a continuous internal oxide film 12 which has been found to inhibit internal oxidation of the aluminum. FIG. 2 similarly indicates the same alloy composition, internally oxidized, but recrystallized prior to internal oxidation to achieve a grain size No. 6 as measured by ASTM Test E-112. No oxide film is formed on the outer periphery of the recrystallized alloy 14 as compared to nonrecrystallized alloy 10 shown in FIG. 1.

Referring now to the powdered alloy, the preferred powder alloy comprises a relatively noble matrix metal having a negative free energy of oxide formation at 25° C of up to 70 kilocalories per gram atom of oxygen, and a solute metal having a negative free energy of oxide formation exceeding that of the relatively noble matrix metal by at least about 60 kilocalories per gram atom of oxygen at 25° C. The relatively noble matrix metal and the solute metal are alloyed by conventional techniques such as melting them under inert or reducing conditions and thereafter comminuting the alloy by atomization or other conventional size-reduction techniques such as grinding or ball milling to form a particulate alloy having an average particle size of less than about 300 microns. Suitable noble matrix metals include, for example, iron, cobalt, nickel, copper, cadmium, thallium, germanium, tin, lead, antimony, bismuth, molybdenum, tungsten, rhenium, indium, silver, gold, ruthenium, palladium, osmium, platinum, and rhodium. Suitable solute metals include, for example, silicon, titanium, zirconium, aliminum, beryllium, thorium, chromium, magnesium, manganese. The alloy composition comprises about 0.01% to about 2 weight percent of solute metal with the balance being relatively noble matrix metal and, if desired, minor amounts of conventional additives to improve abrasion resistance, hardness, conductivity, and other selected properties.

In accordance with this invention, the comminuted alloy powder is first recrystallized at elevated annealing temperatures of the alloy to increase the grain size of the alloy powder to achieve at least about ASTM Grain Size No. 6 measured by ASTM Test No. E-112. The process of recrystallization ordinarily consists of annealing the alloy to produce a new grain structure. Recrystallization diagrams for most metals and alloys are published, as indicated in "Practical Metallurgy," by Sachs and Van Horn, particularly Chapter 5, 3rd printing, 1943, and incorporated herein by reference. Annealing temperatures depend on the alloy to be dispersion strengthened and such temperatures are high enough to efficiently cause recrystallization but at temperatures substantially lower than the melting point of the alloy. For a predominantly copper alloy with minor amounts of aluminum, for example, desirable recrystallization takes place after heating for at least an hour at a temperature of about 1600° F in an inert atmosphere such as argon. Much lower recrystallization temperatures may be utilized, such as 600° F to 700° F, but lower temperatures necessitate increased heat times. Increasing the grain size of the alloy powder prior to internal oxidation has been found to effectively minimize the tendency for solute metal oxide to concentrate at the powder grain boundaries during internal oxidation which undesirably may cause early failure under stress at the grain boundaries in the final dispersion-strengthened metal product.

After recrystallization, the alloy powder is internally oxidized by conventional methods such as disclosed in prior art processes disclosed hereinbefore and identified as patents issued to Schreiner, McDonald, and Grant, and the same are included herein by reference. For example, the Schreiner patent, U.S. No. 3,488,183 provides a suitable method of internal oxidation of an alloy by controlling partial pressure of oxygen produced by dissociation of metal oxide within a two-compartment chamber. The McDonald patent, U.S. No. 3,552,954, provides internal oxidation of a copper alloy within an oxygen atmosphere to saturate the copper with oxygen and thereafter reducing with hydrogen. The Grant patent, U.S. No. 3,179,515, suggests internal oxidation by first oxidizing a copper alloy in air to form a surface layer of $Cu_2O$ followed by continued heating to diffuse oxygen into the copper matrix followed by hydrogen reduction.

A particularly preferred method of internally oxidizing is disclosed in said copending application, now being U.S. Pat. No. 3,779,714, and provides for an intimate admixture of alloy powder with oxidant. The disclosed oxidant comprises a pulverant, in situ heat-reducible metal oxide having a negative free energy of formation ranging up to 70 kilocalories per gram atom of oxygen at 25° C in intimate interspersion with discrete particles of hard, refractory metal oxide, the negative free energy of formation of said hard, refractory metal oxide exceeding the negative free energy of formation of said heat-reducible metal oxide by at least 60 kilocalories per gram atom of oxygen at 25° C. Suitable heat-reducible metal oxides include, for example, oxides of iron, cobalt, nickel, copper, cadmium, thallium, germanium, tin, lead, antimony, bismuth, molybdenum, tungsten, rhenium, indium, silver, gold, ruthenium, palladium, osmium, platinum, and rhodium. Suitable hard, refractory metal oxides include, for example, oxides of silicon, titanium, zirconium, aluminum, beryllium, thorium, chromium, magnesium, manganese.

In any particular combination of the matrix metal and the solute metal in the alloy to be internally oxidized by the preferred method, the matrix metal must be relatively noble with respect to the solute metal so that the solute metal will be preferentially oxidized. This is achieved by selecting the solute metal such that its negative free energy of oxide formation at 25° C is at least 60 kilocalories per gram atom of oxygen greater than the negative free energy of formation of the oxide of the matrix metal at 25° C. Generally, such solute metals have a negative free energy of ozide formation per gram atom of oxygen of over 80 kilocalories and preferably over 120 kilocalories. Similarly, the metal moiety of the heat-reducible metal oxide in the oxidant preferably is the same metal as matrix metal present in the alloy to be internally oxidized, although the heat-reducible metal oxide moiety can be different. Similarly, the hard, refractory metal oxide in the oxidant preferably is the same as the solute metal oxide formed in the alloy during internal oxidation of the alloy, although the refractory metal oxide in the oxidant can be different from the solute metal oxide in the internally oxidized alloy, as more particularly set forth in said copending application, now being U.S. Pat. No. 3,779,714.

As indicated, the oxidant for internally oxidizing the powdered alloy by the preferred method is a mixture of an in situ heat-reducible metal oxide and a hard, refractory metal oxide. Several methods of forming a suitable oxidant are described in said copending application, now being U.S. Pat. No. 3,779,714 and include, for example, decomposing an oxide-forming salt of a refractory metal on particles of heat-reducible metal oxide in the micron or submicron range, or coprecipitation of oxide-forming compounds from their respective salt solutions, or physical blending of the desired oxide components.

In preparing the alloy-oxidant mixture in accordance with the preferred method, at least about 0.1 weight parts of oxidant are combined with 100 weight parts of powder alloy and desirably between about 0.1 to 20 weight parts of oxidant. Preferably, about 0.1 to 10 weight parts of oxidant are combined with about 100 weight parts of powder alloy. The exact proportions of the oxidant relative to the alloy depends on the solute metal of the alloy to be oxidized, and the oxygen content of the oxidant. The amount of such oxidant to be added may be determined by the stoichiometric amount of oxygen required to completely oxidize the solute metal. In this regard, the heat-reducible metal oxide is added in sufficient amounts to completely oxidize the solute metal in the alloy, whereas the amount of hard, refractory metal oxide depends upon the amount of heat-reducible metal oxide. The residue of heat-reducible metal oxide present after internal oxidation is dispersion strengthened by coalescence by the hard, refractory metal oxide. Sufficient oxidant is utilized to completely oxidize the solute metal in the alloy, however, if excessive oxidant is utilized, the resulting internally oxidized metal powder may then be reduced with hydrogen at temperatures of about 1500° F for time sufficient to reduce residual oxygen.

The following illustrative examples are included to further explain the invention and are not intended to be limiting. All parts are by weight and all temperatures are in degrees Fahrenheit, unless otherwise stated.

EXAMPLE 1

Part A — Preparation of the Alloy Powder — Electrolytic tough-pitch grade copper rods are melted in an inert refractory crucible in an induction-heating furnace under reducing conditions at about 2300° F. Metallic aluminum shavings are introduced into the molten copper in the proportion of 0.33% by weight of the resulting molten metallic mass.

The molten solution of aluminum in copper is then superheated to 2400° F, atomized through an atomizing aperture in a jet of nitrogen (alternatively other inert gases or water or steam can be used at the atomizing fluid) to yield an atomized copper-aluminum alloy powder which substantially all passes a 100-mesh, U.S. Sieve indicating that the average particle size is less than about 149 microns.

The atomized and screened alloy powder is annealed at a temperature of about 1600° F for about an hour in an argon atmosphere to recrystallize and yield a grain size in the recrystallized alloy powder of at least about ASTM Grain Size 6 according to ASTM Test E-112. Preferably, the grains are as large as possible to minimize grain boundary area in the powder. The alloy powder is then ready for use in combination with the oxidant.

Part B — Preparation of the Oxidant — One hundred parts of commercially available cuprous oxide ($Cu_2O$) with an average particle size of about 1 to 2 microns are mixed with 4.1 parts of an aqueous solution of $Al(NO_3)_3 \cdot 9H_2O$ to form a slurry of cuprous oxide in aluminum nitrate solution. The solution of aluminum nitrate is slurried with cuprous oxide particles, and the stirring is continued with mild heating at 200° F until the water has evaporated and the mixture is almost dry. The mixture is then heated at a temperature of about 500° F for one-half hour to decompose the aluminum nitrate into aluminum oxide. The resulting agglomerate is then ground to form fine oxidant powder which passes a 325-mesh sieve. The resulting oxidant powder comprises 77.43% $Cu_2O$, 22.01% CuO, and 0.56% $Al_2O_3$ by weight.

Part C — Preparation of the Internally Oxidizable Alloy Powder-Oxidant Mixture — The alloy powder of Part A is thoroughly mixed with the oxidant powder of Part B in the proportion of 2.12 parts of oxidant to 100 parts of alloy powder. The mixing is accomplished in a ball-mill, although a conventional V-cone blending device can alternatively be used.

Part D — Internal Oxidation of the Alloy Powder — The alloy powder-oxidant mixture of Part C is then charged to an internal oxidation vessel which is then sealed. The oxidation vessel is copper or copper-lined steel to avoid contamination of the alloy powder-oxidant mixture during oxidation.

The alloy powder-oxidant mixture is then brought to a temperature of about 1750° F and maintained at this temperature for about 30 minutes to effectuate internal oxidation of the alloy powder. Alternatively, the internal oxidation can be carried out on a continuous basis using a continuous belt furnace maintained under an inert atmosphere.

At the end of the 30-minute internal oxidation period, substantially all of the aluminum in the alloy powder has been oxidized to $Al_2O_3$ and substantially all of the cuprous oxide in the oxidant has been reduced to metallic copper. The particles of internally oxidized alloy comprise 99.37% by weight of copper plus minor amounts of impurities and 0.63% by weight of $Al_2O_3$. The oxidant residue comprises 99.37% copper particles and 0.63% $Al_2O_3$ particles. The overall internally oxidized metal powder composition comprises 98.21% internally oxidized alloy powder and 1.79% oxidant residue.

Part E — Reduction of the Internally Oxidized Metal Powder — The internally oxidized metal powder of Part D is then placed in a reducing atmosphere of hydrogen at a temperature of about 1500° F for one hour to reduce any residual copper oxide.

Part F — Thermal Coalescence or Consolidation of the Internally Oxidized Metal Powder — The internally oxidized and reduced metal powder of Part E is then charged under an inert argon atmosphere to a thin-walled copper can having a diameter of about 7 inches and equipped with a feed tube. The can and its contents are heated to about 1700° F and the feed tube sealed. Alternatively instead of using the inert gas atmosphere, the feed tube is attached to a vacuum pump; and the can is evacuated while the temperature of the can is brought to 1700° F to remove any occluded gas from the powder. After evacuation at a pressure of $1 \times 10^{-5}$mm of Hg for 60 minutes at 1700° F, the feed tube is sealed and disconnected from the vacuum pump.

The sealed can is then placed in a ram-type extrusion press and is extruded to form extrudate in the shape of cylindrical bar stock having a diameter of about 1.25 inches. This corresponds to an extrusion ratio of about 31:1 (i.e., the ratio of the cross-sectional area of the can to the ratio of the cross-sectional area of the extrudate).

The bar stock comprises about 99.37% copper having dispersed throughout 0.63% (or about 1.5% by volume) of $Al_2O_3$ particles and has a density of about 99.3% of the theoretical density. The bar stock has an electrical conductivity of 88% IACS*, a tensile strength of about 72,000 psi, an elongation of 19% using ASTM Test E-8 (for a test specimen 0.16 inch diameter and 0.65 inch gage length) and a Rockwell hardness of about 75 units on the B scale. All property measurements reported in the example are conducted at room temperature. The bar stock is substantially uniform and does not possess the compositional defects that normally result when the spent oxidant is present in the dispersion-strengthened workpiece.

*International Annealed Copper Standard — A copper wire 1 meter long weighing 1 gram, having a resistance of 0.15328 ohms. at 20° C has a conductivity of 100% IACS (Kirk-Othmer: *Encyclopedia of Chemical Technology*, Second Edition, Volume VI, Interscience Publishers, Inc., 1965, p. 133).

The bar stock is suitable for use as is, or it can be cold worked by swaging, forging, rolling, wire drawing, cold extrusion or cold drawing to form workpieces having particular tensile strengths according to conventional cold working techniques.

For instance, when the bar stock is reduced to 50% in cross-sectional area by coldswaging, the tensile strength is 80,000 psi, the elongation is 13%, and Rockwell B hardness is 84 units and conductivity is 86% IACS.

This swaged material with a Rockwell B hardness of 84 units and prepared by the procedure of Example 1 is annealed along with a commercial copper-chromium alloy (0.9% Cr) at various temperatures for one hour in argon. Improved hardness values are obtained by annealing for one hour at the various temperatures ranging from 100° F to 1500° F. In another experiment, these same two materials are annealed together at 1000° F in argon. Samples are removed from the annealing furnace at various time intervals, cooled to room temperature, and tested for hardness. The test results show superior resistance to softening upon heating of the dispersion-strengthened workpiece of this invention.

EXAMPLE 2

A copper alloy similar to Example 1 and containing 0.31 weight percent of aluminum is nitrogen atomized to produce alloy powder. The alloy powder is divided into two fractions, namely: −80 +325 mesh fraction, and a −325 mesh fraction. Each fraction is treated with a grain growth step and compared with a fraction that did not undergo grain growth. In the grain growth fraction, the atomized powder is subjected to recrystallization treatment at 1800° F for one hour under argon atmosphere prior to internal oxidation. Prior to recrystallization, the average grain diameter is 0.00397 millimeters, whereas after recrystallization the average grain diameter is 0.045 millimeters. Both the non-treated atomized powder and the recrystallized atomized powder are each blended with stoichiometric amounts of oxidant consisting of an intimate mixture of submicron $Cu_2O$ and $Al_2O_3$ and internally oxidized, as indicated in Example 1, at 1750° F in argon for about 30 minutes. Both the non-treated and the recrystallized mixtures are then reduced to 1500° F for one hour in hydrogen to remove any excess oxygen. The reduced powder mixtures are then cold compacted in a rectangular die 7.5 cm × 1 cm at a compacting pressure of 40 tsi to yield a compact with 1 cm square cross section. The compact is hot forged to 99.3% density and then cold forged to give about 30% reduction in area. Vicker's hardnesses are then determined on the cold forged bars and then measured after additional annealing treatment of 1500° F for an hour in argon. The Vicker's (DPH) Diamond Pyramid Hardnesses are measured in Kilograms per $mm^2$ at a 15 gram load and the results thereof are indicated in Table 1 below.

Table 1 shows that higher inherent hardnesses are obtained when the atomized alloy powder is recrystallized prior to internal oxidation concurrent with an improved resistance to softening upon further heating to elevated temperatures.

TABLE 1

| Sample No. | Mesh Fraction | Processing | Grain Size (average diameter) | Vicker's Hardness DPH (as forged) kg/mm² at 15g. load | Vicker's Hardness DPH (annealed 1 hr. at 1500° F) kg/mm² at 15 g. load |
|---|---|---|---|---|---|
| 2(a) | −80+325 | with grain growth | 0.045 mm | 149 kg/mm² | 139 kg/mm² |
| 2(b) | −80+325 | without grain growth | 0.00397 mm | 122 kg/mm² | 103 kg/mm² |
| 2(c) | −325 | with grain growth | 0.045 mm | 153 kg/mm² | 153 kg/mm² |
| 2(d) | −325 | without grain growth | 0.00397 mm | 150 kg/mm² | 132 kg/mm² |

EXAMPLE 3

An alloy of copper having 0.70% aluminum is prepared in a manner set forth in Example 1 (part A). One sample (a) of this alloy powder is processed in a manner set forth in Example 1 including the step of recrystallizing to increase the grain size prior to internal oxidation. A second sample (b) is processed similarly but with the exception that the grain growth step is excluded. Both powders (a) and (b) are mounted, polished, and etched. The non-recrystallized (no grain growth) powder (b) shows a continuous internal oxide film after internal oxidation, whereas the recrystallized (grain growth) powder (a) does not indicate an oxide film. Vicker's Diamond Pyramid Hardness (DPH) taken at 15 q. load on the internally oxidated powders (a) and (b) after internal oxidation in a manner set forth in Example 1 indicate the following hardnesses:

Recrystallized powder (a):
189 kg/mm²

Non-recrystallized powder (b):
94 kg/mm² inside the internal oxide film
161 kg/mm² outside or at the internal oxide film.

Both powders (a) and (b) are then canned in a 1.25 inches diameter and 2 inches long copper containers and extruded at 1700° F into 0.25 inch diameter rods. Rockwell hardness, electrical conductivity, and ultimate tensile strength are determined and are set forth in Table 2.

TABLE 2

| Sample No. | Processing | Rockwell Hardness | Electrical Conductivity % IACS | Tensile Strength |
|---|---|---|---|---|
| 3(a) | with grain growth | 90 | 79% | 85,000 psi |
| 3(b) | without grain growth | 83 | 75% | 80,000 psi |

EXAMPLE 4

Two fractions of −100 mesh copper alloy powder containing 0.70% aluminum are surface oxidized at 450° C for about one-half hour to pick up sufficient oxygen for complete oxidation of the 0.70% Al in the alloy powder. One fraction (a) is previously recrystallized for increasing the grain size in the manner set forth in Example 2, but the other fraction (b) is not subjected to a grain growth step. Both fractions (a) and (b) are internally oxidized at 1750° F for one-half hour and then reduced to remove any excess oxygen. Each fraction is individually canned within a 1.25 inches diameter and 2 inches long copper container, preheated, and extruded at about 1700° F into 0.25 inch diameter rods. Rockwell hardness, electrical conductivity, and ultimate tensile strength on these rods are shown in Table 3.

TABLE 3

| Sample No. | Processing | Rockwell Hardness | Electrical Conductivity % IACS | Tensile Strength psi |
|---|---|---|---|---|
| 4(a) | with grain growth | 89 | 78% | 85,000 psi |
| 4(b) | without grain growth | 82 | 80% | 79,000 psi |

EXAMPLE 5

In accordance with the procedures set forth in Example 1, a nickel alloy containing 0.45% aluminum by weight is nitrogen atomized to produce an alloy powder. The alloy powder is divided into two fractions, namely, one fraction recrystallized in a grain growth step, and the other fraction did not undergo grain growth. In the grain growth fraction, the atomized nickel alloy powder is subjected to recrystallization treatment at about 1800° F for one hour under argon atmosphere to achieve a grain size No. 6. Both the recrystallized fraction and the non-treated fraction of the nickel alloy powder is then mixed with 1.89 weight parts of pulverant oxidant comprising 1.87 parts of nickel oxide and 0.02 parts of aluminum oxide per 100 weight parts of powder alloy. The nickel alloy and oxidant mixtures are then internally oxidized as indicated in Example 1 at 1750° F in argon for about 3 hours. Both fractions are then reduced with hydrogen at 1500° F for about one hour to remove any excess oxygen. The reduced powder mixtures are then cold compacted and hot forged in the manner set forth in Example 2 and tested. The recrystallized alloy fraction undergoing grain growth to achieve a grain size number of at least 6 indicates substantially improved Vicker's hardness, Rockwell hardness, electrical conductivity, and tensile strength when compared to the other non-recrystallized alloy fraction.

EXAMPLE 6

A silver alloy containing 99.04% silver and 0.48% aluminum is nitrogen atomized in a manner similar to Example 1 to produce an alloy powder. The alloy powder is then separated into two fractions wherein one fraction is recrystallized with a grain growth step whereas the second fraction is not treated to undergo grain growth. In the grain growth fraction, the atomized alloy powder is subjected to recrystallization treatment at about 1500° F for about one hour under argon atmosphere to achieve a grain size of No. 6. Both the recrystallized and the non-treated fractions are combined with 6.35 parts of pulverant oxidant comprising 6.24 parts of silver oxide and 0.11 parts of aluminum oxide. Both fractions are then internally oxidized at 1200° F in argon for about 1 hour in the manner indicated in Example 1. Each fraction is reduced, compacted, and hot forged as indicated in Example 2. The recrystallized fraction exhibits substantially improved Vicker's hardness, Rockwell hardness, electrical conductivity, and tensile strength when compared to the non-treated fraction.

The foregoing examples indicate that recrystallizing and increasing the grain size of the alloy powder prior to internal oxidation substantially improves the physical properties of dispersion strengthened metal products. The examples are not intended to be limiting to the scope of this invention as defined in the following claims.

I claim:

1. In a process for dispersion strengthening metal including the steps of providing a powdered alloy of relatively noble matrix metal and solute metal, the matrix metal having a relatively low free energy oxide formation and the solute metal having a relatively high negative free energy of oxide formation, and the step of internally oxidizing said powdered alloy, the improvement comprising:

increasing the grain size of said alloy prior to the step of internal oxidation at recrystallizing temperatures of said alloy in an inert atmosphere for time sufficient to increase the grain size of said alloy to a grain size of at least Grain Size No. 6 as measured by ASTM E-112.

2. A process for dispersion strengthening of metal by internal oxidation comprising:

providing a powdered alloy having an average particle size of less than 300 microns comprising a matrix metal and a solute metal, said matrix metal having a negative free energy of oxide formation at 25° C. of up to 70 kilocalories per gram atom of oxygen, said solute metal having a negative free energy of oxide formation exceeding the negative free energy of oxide formation of said matrix metal by at least about 60 kilocalories per gram atom of oxygen at 25° C.;

heating said powdered alloy within an inert atmosphere at a temperature and for time sufficient to increase the grain size of said alloy to a grain size of at least Grain Size No. 6 as measured by ASTM Test E-112;

providing an oxidant comprising an intimate interspersion of in situ heat-reducible metal oxide and a finely divided hard refractory metal oxide, said heat-reducible metal oxide having a negative free energy of formation at 25° C. of up to 70 kilocalories per gram atom of oxygen, said refractory metal oxide having a negative free energy of formation exceeding the negative free energy of formation of said heat-reducible metal oxide by at least about 60 kilocalories per gram atom of oxygen at 25° C.;

combining into an intimate mixture at least about 0.1 weight parts of said oxidant with 100 weight parts of said alloy, said oxidant having the heat-reducible metal oxide present in at least stoichiometric proportion for complete internal oxidation of all of said solute metal in said alloy;

internally oxidizing said alloy mixed with said oxidant by heating to oxidize the solute metal of said alloy and to form a residue of heat reducible metal oxide of said oxidant; and thermally coalescing said internally oxidized alloy and said residue into a dispersion-strengthened metal stock.

* * * * *